US005272950A

United States Patent [19]

Petersen

[11] Patent Number: 5,272,950

[45] Date of Patent: Dec. 28, 1993

[54] STRIKING MECHANISM FOR A PIANO

[76] Inventor: Erik I. Petersen, Frederiksborggade 36, 2.v., DK-1360 Copenhagen K, Denmark

[21] Appl. No.: 857,911

[22] PCT Filed: Nov. 16, 1990

[86] PCT No.: PCT/DK90/00295

§ 371 Date: May 15, 1992

§ 102(e) Date: May 15, 1992

[87] PCT Pub. No.: WO91/07740

PCT Pub. Date: May 30, 1991

[30] Foreign Application Priority Data

Nov. 17, 1989 [DK] Denmark ..... 5806/89

[51] Int. Cl.[5] ..... G10C 3/16

[52] U.S. Cl. ..... 84/236; 84/247; 84/253

[58] Field of Search ..... 84/240, 236, 237, 242, 84/238, 239, 241, 217, 218, 247, 248, 249, 253

[56] References Cited

U.S. PATENT DOCUMENTS 1,071,801 9/1913 Schimmel .
1,125,304 1/1915 Gilmore .
2,419,174 4/1947 Socin .
2,436,875 3/1948 Socin .
3,151,516 10/1964 Bernstein .
3,651,732 3/1972 Erbert et al. ..... 84/240
4,161,219 7/1979 Carbone ..... 84/253
4,854,211 8/1989 Tanaka et al. ..... 84/240
4,879,939 11/1989 Wall ..... 84/240

*Primary Examiner*—Bernard Roskoski
*Assistant Examiner*—Jeffrey W. Donels
*Attorney, Agent, or Firm*—Michael L. Dunn

[57] ABSTRACT

In a striking mechanism (1) for a piano, grand piano, or similar string instrument the power for the key (8*a*) is transferred to the hammer (3) via a rod system (10, 11, and 12) so adapted that the connection of the key (8*a*) and the hammer (3) is never interrupted. The rod system (10, 11, and 12) is supported during the striking movement against deflection by a first guide boss or roller (18) supported by a first curve guide (19), and during the return movement by a second guide boss or roller (20) supported by a second curve guide (21). The first curve guide (19) can swing between a first, advanced position in which it is releasably locked by a locking pawl (28) and the rod system is capable of causing the hammer (3) to touch the string when the key (8*a*) is pressed down, and a released second retracted position in which this is no longer possible. This ensures that the hammer (3) is withdrawn so rapidly after having struck the string (2) that the string can vibrate freely and deliver its note. The structure entails that the playing properties of the string instrument can be utilized better than known before.

20 Claims, 6 Drawing Sheets

STRIKING MECHANISM FOR A PIANO

Figure 1:
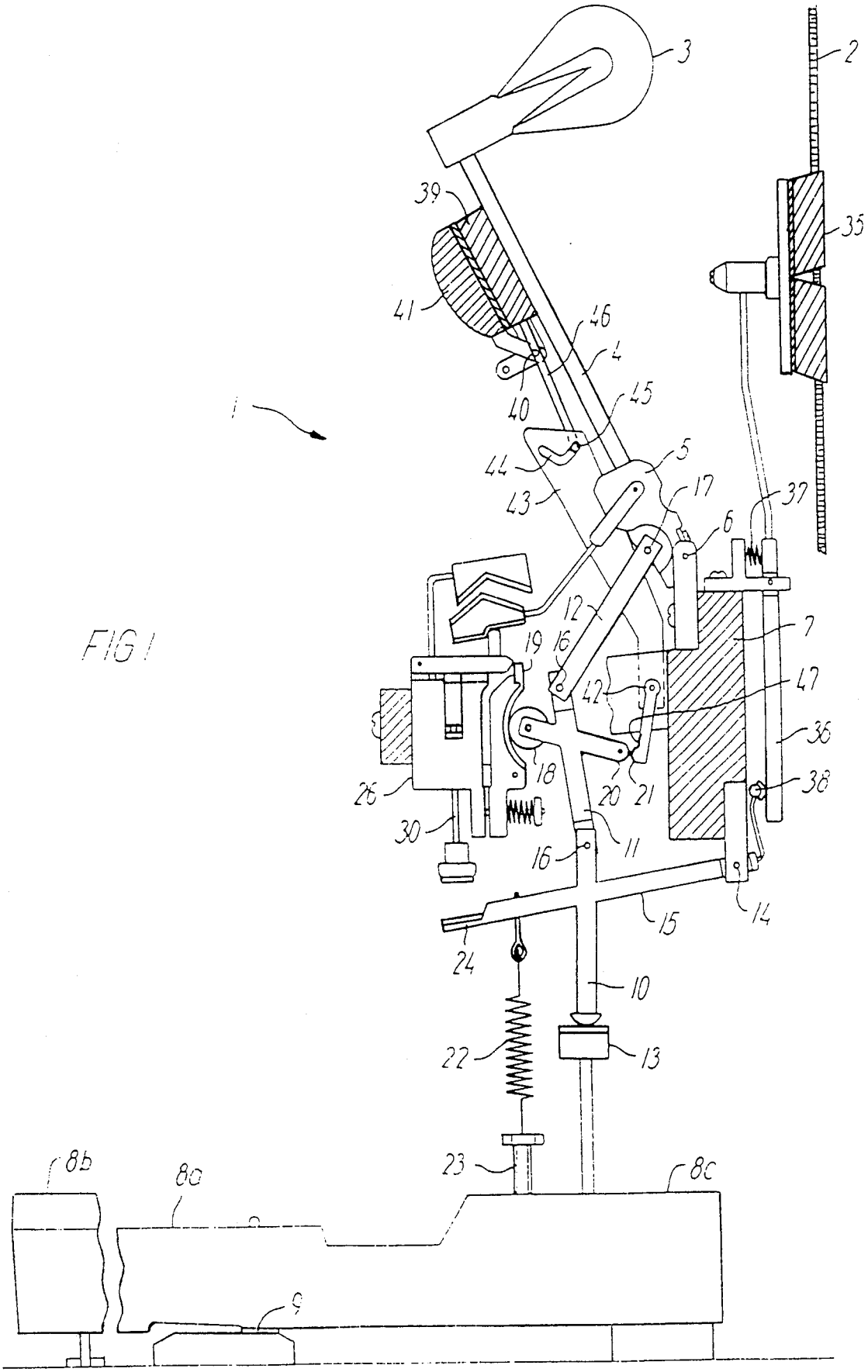

The invention concerns a striking mechanism for a piano, grand piano or similar string instrument, essentially comprising, for each string or set of strings, a hammer butt journalled swingably about a horizontal axis and having a hammer shank carrying a hammer at the free end; a power transmission device acting between the hammer butt and the rear end of the associated key in the keyboard of the instrument for momentarily causing the hammer to strike the string when the key is pressed down; and a check device serving to stop and temporarily retain the hammer during rebound when said hammer has struck the string once.

In conventional power transmission devices of this type the connection between the key and the hammer is interrupted before the hammer strikes the string, and then the swing movement of the hammer continues by means of the added kinetic energy alone. The connection is also interrupted when just the key is released, and in both cases all the parts incorporated in the power transmission device must be returned to their starting position to be ready for a succeeding strike. However, this takes time and prevents rapid repetition of the strike.

The U.S. Pat. No. 1 071 801 discloses a striking mechanism which has a power transmission device with means comprising i.a. a repeating arm for restoring the power transmitting connection between the hammer and the key immediately after the rebound thereof has commenced. This provides a better repetition, but it is not possible to control the individual or repeating strikes fully.

It is common to the known striking mechanism that they do not enable the pianist to utilize the possibilities of the instrument fully, and the object of the invention is therefore to provide a striking mechanism of the type mentioned in the opening paragraph which has better playing properties than known before.

This is achieved in that the power transmission device of the invention consists of a rod system preferably movably arranged in the swing plane of the hammer, said rod system comprising a lower rod downwardly resting against an abutment on the key and swingably journalled in a fixed instrument part by means of a rearwardly extending arm; an upper rod upwardly swingably connected with the hammer butt; as well as at least one intermediate rod swingably connected with the other rods and having, at the rod system deflection side at striking, a first curve boss or roller supported by a first curve guide during the striking movement, and on the opposite side a second guide boss or roller supported by a second curve guide during the rebound movement; and that the first curve guide is arranged movably in the plane of the rod system on a fixed base member in the instrument, said base member being formed with a locking means to releasably lock the curve guide in a first, advanced position in which the rod system is capable of causing the hammer to touch the string, said striking mechanism having a release means for releasing the locking means by continued depression of the key such that the curve guide is pressed back to a second, retracted position by the first guide boss or roller in which it is not possible for the rod system to cause the hammer to touch the string, as well as a device to return the curve guide to its first advanced position upon cessation or sufficient reduction of the depression force applied to the key. The connection between the key and the hammer is therefore never released, and this entails that the pianist obtains an improved keyboard touch or feel and is capable of controlling the strike better. Further, the strike can be repeated from practically all hammer and key positions. It is therefore possible to repeat the strike in strict accordance with the pianist's intensions and also very quickly. Quick and short passages are less tiresome to play than when using conventional striking mechanisms.

In an advantageous embodiment of the striking mechanism of the invention the striking mechanism may be constructed such that the first curve guide is swingably journalled downwardly on the base member and is affected in a direction inwardly toward the first guide boss or roller by a biassed spring; that the locking means comprises a locking pawl swingably journalled upwardly on the base member and locking the curve guide releasably in its first position by engagement with the upper end of the curve guide, and a lever part preferably arranged vertically slidably in connection with the base member; and that the release means consists of a release arm arranged on the lower rod, said release arm extending below the lever part and serving to lift it during the striking movement such that the upper end of the lever part swings the locking pawl out of the locking engagement with the curve guide, and this is hereby pressed into its second position by the first guide boss or roller as soon as the hammer has struck the string once.

Further, according to the invention, with a view to catching the hammer safely, when it has struck the string once, the striking mechanism in an embodiment, which is particularly useful for a piano, may be constructed such that the check device consists of a stationary check part and a complementarily shaped, movable check part which is swingably connected with the hammer butt, and that the upper side of the locking pawl is formed with an upwardly protruding projection which rests against the underside of the movable check part and is so adapted that it causes the movable check part to engage the stationary check part when the locking pawl is disengaged from the first curve guide.

According to the invention, in another embodiment, which is particularly suitable for grand piano, the safe catching of the hammer may moreover take place in that the striking mechanism is constructed such that the check device consists of a stationary check part and a complementarily shaped, movable check part swingably connected with a hammer butt, and that a swing arm is arranged on a fixed instrument part, said swing arm having an upper part resting against the rear side of the movable check part and the lower part engaged with an abutment on the lower rod such that the movable check part engages the stationary check part when the lower rod, via the lever part, disengages the locking pawl from the first curve guide. However, the swing arm may also be arranged on the lower rod and be actuated by engagement with an abutment on the fixed instrument part.

Conventional striking mechanism for pianos usually comprise a damper bar arranged swingably about a horizontal axis in the instrument for moving the rest position of the hammer closer to the string when less loudness is desired at striking. To obtain a greater register in connection with such damping and less repercussion from the damping setting to the key resistance, the striking mechanism of the invention may moreover be constructed such that it comprises at least a substantially vertically arranged damper arm capable of tilting about a bearing which is arranged on a fixed instrument part with a relatively small upward spacing from the second curve guide which is secured to the downwardly facing part of the damper arm, the upwardly facing part of the damper arm engaging a control rod associated with the damper bar such that the second curve guide, in any of the positions of the damper bar, is spaced sufficiently from the first curve guide such that the second guide boss or roller does not, or only insignificantly, touch the second curve guide when the key is in its rest position.

In conventional grand pianos damping takes place by moving the striking mechanism laterally so far that each hammer will only strike two of the three strings in each set of strings. However, by means of the striking mechanism of the invention it is now possible also to use a damper bar for damping grand pianos in such a manner that, when damped, each hammer strikes all the strings in the set of strings so that the grand piano maintains its timbre when damped. This is achieved in that the striking mechanism of the invention is constructed such that it comprises a damper bar which serves to move the rest position of the hammer closer to the string or set of strings when less loudness is desired, and which can swing about a horizontal axis via a swing arm journalled in a fixed instrument part, and that the mechanism moreover comprises at least one lever connected with a damper pedal for swinging the swing arm, and that the second curve guide is swingably journalled in a fixed instrument part, said lever engaging the curve guide such that, in any of the positions of the damper bar, it is spaced sufficiently from the first curve guide such that the second guide boss or roller does not, or only insignificantly, touch the second curve guide when the key is in its rest position.

Further, according to the invention, a spring may be fixed between the rear end part of the key and the release arm of the lower rod, said spring having a biassed spring force which can be adjusted by means of an adjusting screw and which preferably has such a size that, together with the other reaction force from the mechanism, it essentially imparts the same depression resistance to the key as is found in conventional string instruments of this type. The resistance, which the pianist has to overcome when pressing down the key, can hereby be adjusted to the size which is ordinarily used in conventional striking mechanisms. Without this spring the striking mechanism of the invention would present less resistance to pressing of the key than the conventional mechanisms, since the friction in its various parts is smaller, and the masses to be moved against the action of gravity are smaller and are also partially absorbed by the first curve guide. This entails that the biassed spring force will constitute an essential part of the overall key resistance, which can therefore be adjusted to the temperament and the finger strength of the individual pianist within wide limits.

According to the invention, the first curve guide curve may moreover be formed such that the striking movement of the hammer takes place with an increased speed when the key is pressed down with a constant speed. In conventional striking mechanisms the key/-hammer ratio is such that when the key is pressed down evenly, the hammer is given a constant angular speed, or an angular speed which even decreases when the key approaches its bottom position. That strike has taken place is signalled to the pianist only when he hears the note of the struck string or feels that the key bottoms. By means of the above-mentioned embodiment of the first curve guide, the pianist now encounters increasing key resistance during striking, which enables him to physiologically follow the travel of the hammer and thereby register the time of its termination in advance. Since the pianist can hereby prepare himself for performing the next strike earlier than known before, he will be enabled to control his execution and in particular of quick passages much better. Further, quick repetitions will be more easy since the distance which the key is to be pressed down for each strike, is smaller near the bottom position of the key than in its rest position.

To obtain an expedient rebound of the hammer and the power transmission device as free of play as possible, the second curve guide curve may moreover according to the invention be the envelope of the movement described by the second guide boss or roller when the first guide boss or roller follows the first curve guide curve during the striking movement.

Moreover, according to the invention, in a preferred embodiment, which is particularly suitable for grand pianos, the striking mechanism may comprise a spring or a similar device which is connected partly with a fixed instrument part, partly with the hammer or its hammer shank, and this spring or similar device may be biassed by a force acting on the hammer or the hammer shank in the same direction as the striking movement of the hammer. The mechanism will hereby operate more easily and be worn less since the weight of the hammer is now essentially absorbed by the said spring instead of, as before, being transmitted through the entire power transmission system to be compensated by e.g lead counterweights in the key.

In a particularly preferred embodiment of the invention the first and the second guide bosses or rollers are integrated in one guide boss or roller. The structure will hereby be particularly simple, light and effective.

Figure 2:
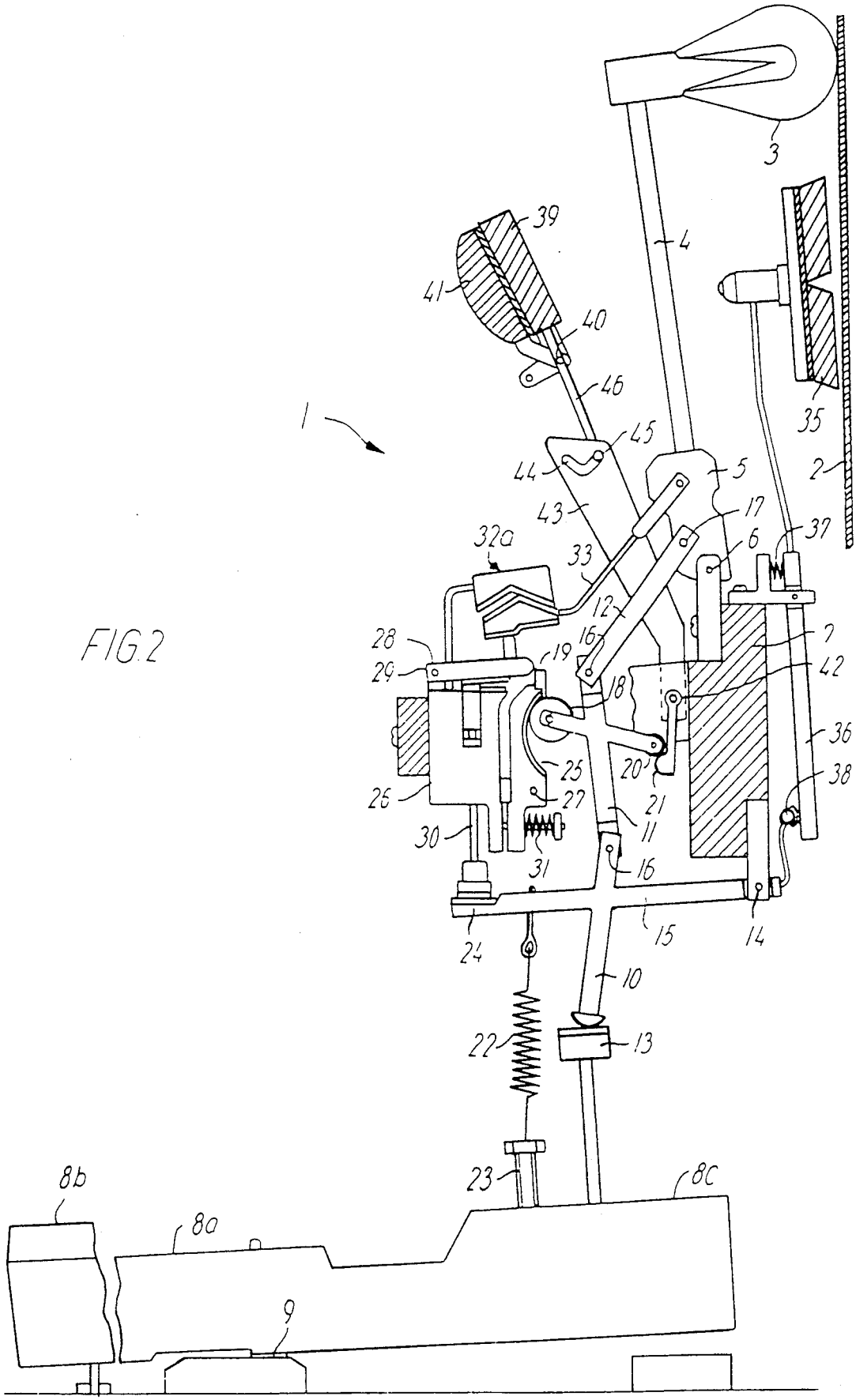
Figure 3:
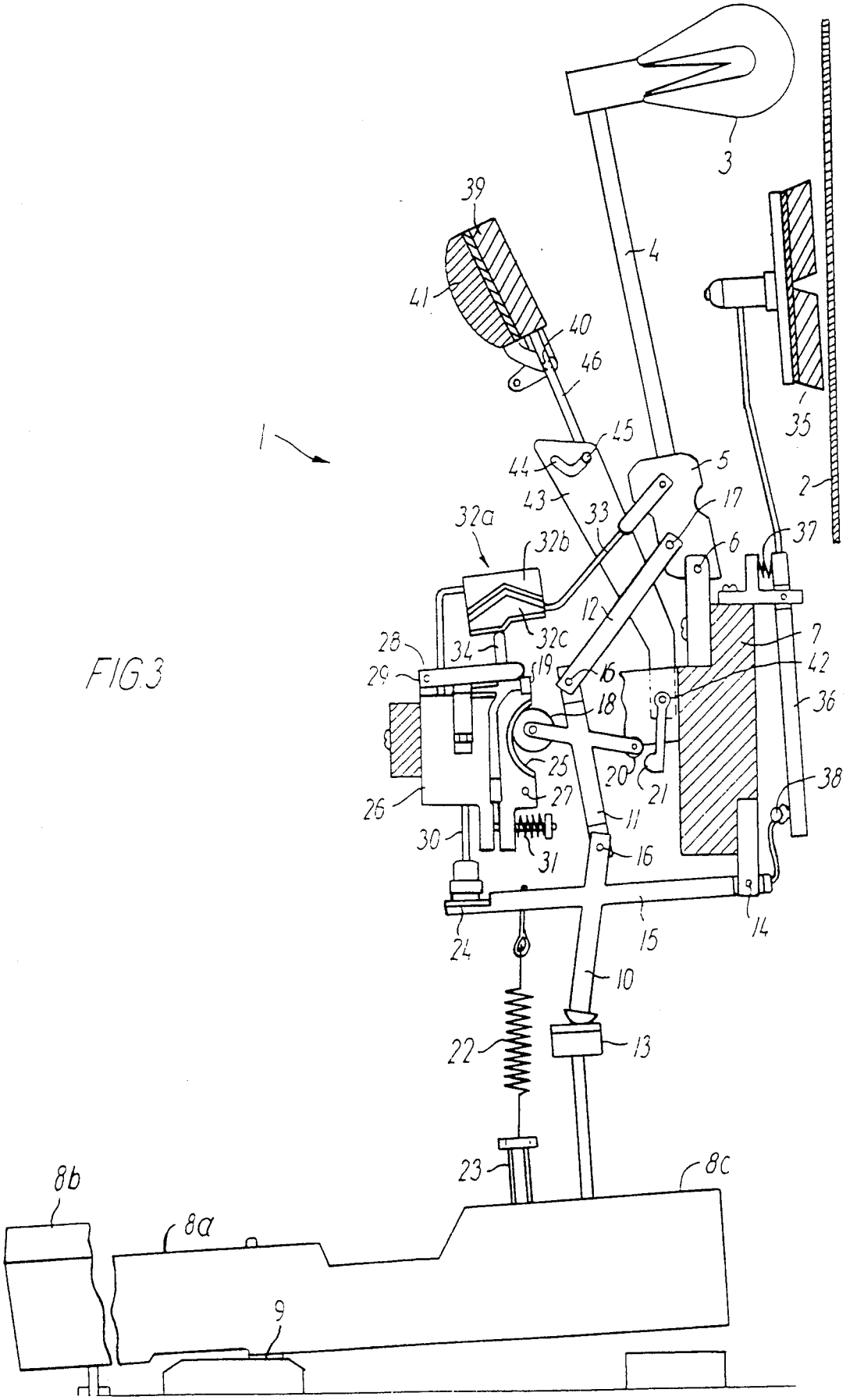
Figure 4:
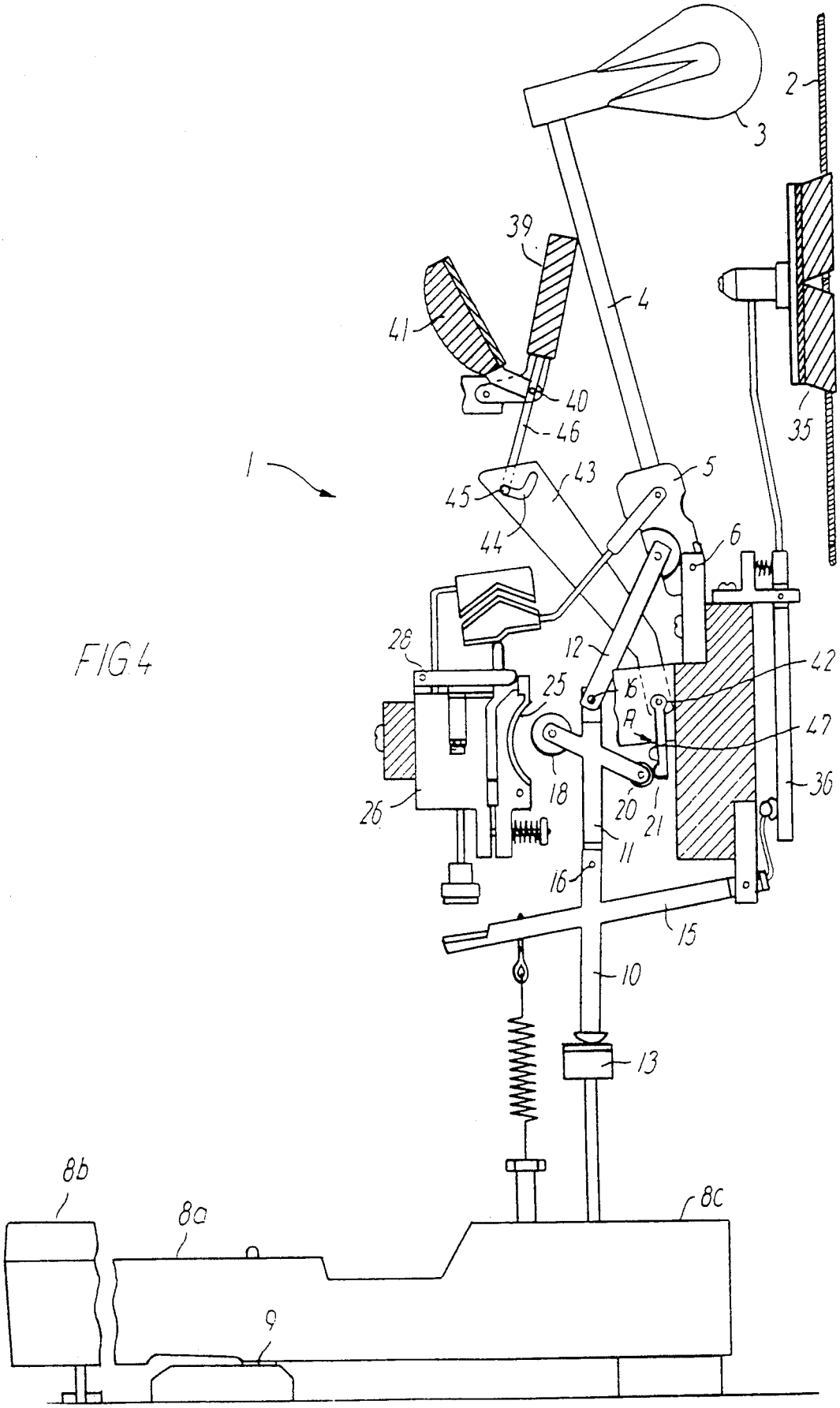
Figure 5:
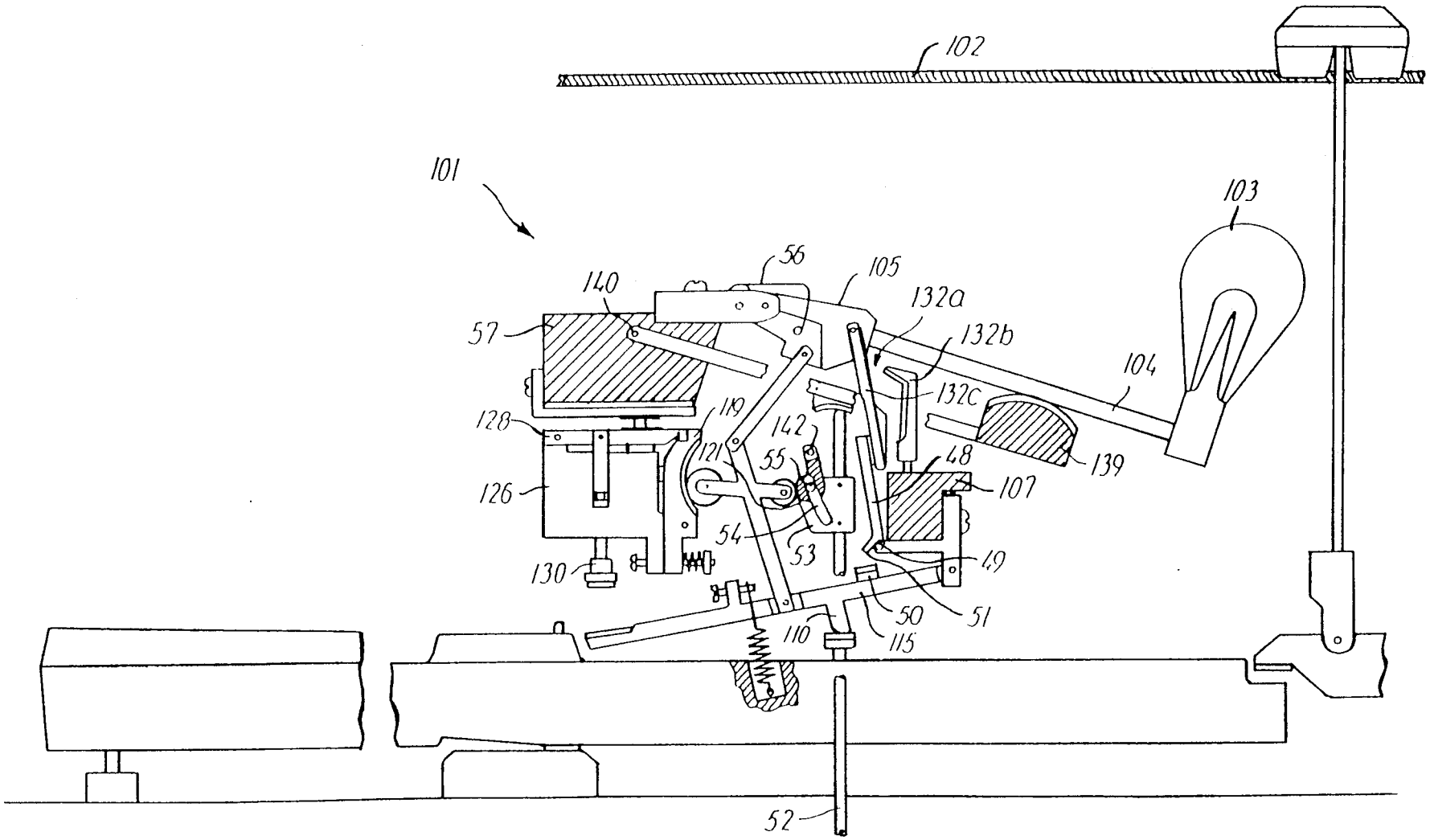
Figure 6:
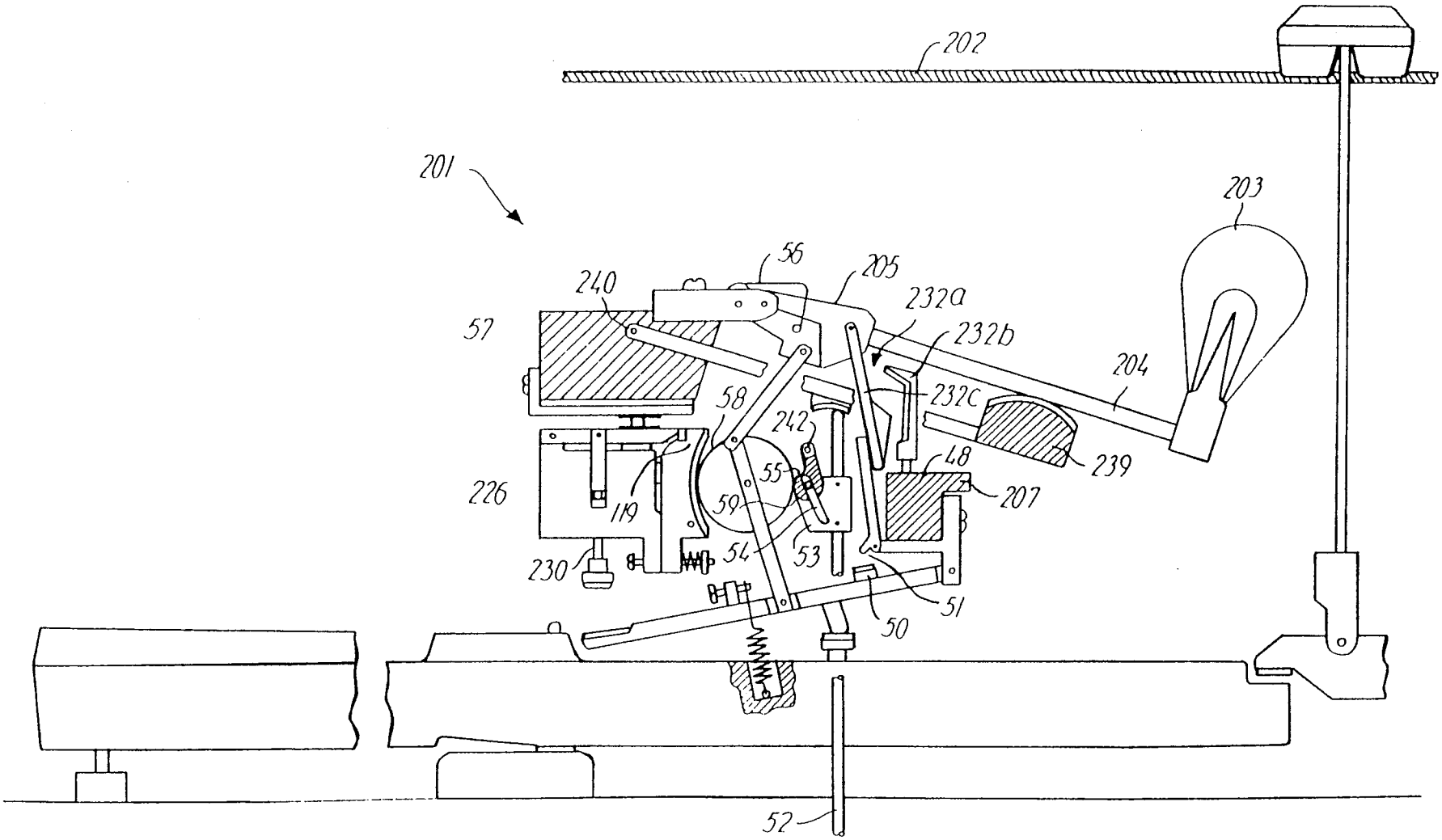

The invention will be explained more fully by the following description of some exemplary embodiments with reference to the drawing, in which FIG. 1 is a partially sectional lateral view of an embodiment of a striking mechanism according to the invention in the rest position, which is particularly suitable for a piano, FIG. 2 shows the same, but at the moment of striking, FIG. 3 shows the same, but upon catch, FIG. 4 shows the striking mechanism of FIG. 1, but with a damper bar in a forwardly tilted position in which it brings the hammer closer to the string, FIG. 5 is a partially sectional lateral view of a second embodiment of a striking mechanism according to the invention in the rest position, which is particularly suitable for a grand piano, and FIG. 6 is a partially sectional lateral view of a third embodiment of a striking mechanism according to the invention in the rest position, which is particularly intended for a grand piano.

FIG. 1 shows a striking mechanism which is generally designated by 1. This embodiment has vertical strings 2 and is particularly suitable for a piano. A hammer 3 is provided for each string 2—or set of strings—connected via a hammer shank 4 with a hammer butt 5 swingably mounted in a bearing 6 on a fixed instrument part 7, which consists of a bar extending longitudinally of the entire keyboard. The figure shows at the bottom a key 8a which can tilt about a tilting bearing 9, and which serves to cause the hammer 3 to strike the string 2 by pressure on the front end 8b of the key, the force with which the key is pressed down being transmitted to the hammer butt 5 via a power transmission device in the form of a rod system which can move in the swing plane of the hammer.

This rod system comprises a lower rod 10, an intermediate rod 11 and an upper rod 12. The lower rod 10 downwardly rests against an abutment 13 on the rear key end 8c and is swingably suspended from a bearing 14 on the fixed instrument part 7 by means of a rearwardly extending arm 15. The rods 10, 11 and 12 of the rod system are interconnected with links 16, as shown, and the upper rod 12 is connected with the hammer butt 5 by means of a link 17. Thus, between the abutment 13 and the hammer 5 there is a constantly coupled connection which is not interrupted like in the conventional structures to enable the hammer to swing clear of the string after this has been struck once.

During striking, the rod system is affected by pressure forces which, without further support of the system, would make it deflect laterally since the rods 10, 11 and 12 of the system form major or minor angles with each other. A first guide boss or roller 18, resting against a first curve guide 19, is arranged on the intermediate rod 11 to balance the rod system. Similarly, a second guide boss or roller 20, resting against a second curve guide 21, is arranged on the opposite side of the intermediate rod 11, thereby insuring the state of equilibrium of the rod system during rebound where the rod system is affected by the tensile force from a tension spring 22 which is fixed between an adjusting screw 23 on the rear end 8c of the key 8a and a release arm 24 which—as seen in the figure—protrudes to the left from the lower rod 10. The function of the release arm 24 will be explained more fully below.

FIG. 2 shows the mechanism at the moment of striking, i.e. when the hammer has just reached the key to vibrate it. As will be seen, the first guide boss or roller 18 has now moved a distance upwardly along an expediently shaped first curve 25 on the first curve guide 19, and the hammer is in touch with the string. If the first curve guide 19 is firmly mounted in the instrument, this state will be maintained as long as the key is kept depressed, so that the string cannot vibrate freely. This is also the case even if the key is released immediately, since the hammer cannot be removed as quickly from the string as the string vibrates.

The first curve guide 19 is therefore mounted so that it can swing about a link 27 on a fixed base member 26 between a first, advanced position in which the rod system is capable of causing the hammer to touch the string, and a second, retracted position in which this is no longer possible.

A locking pawl 28 is arranged upwardly on the base member 26 where it can swing up and down about a link 29. In the lower position, the locking pawl engages the upper end of the first curve guide 19, which is thereby kept locked in its first, advanced position which serves to control the rod system during the strike.

A lever part 30 extends vertically downwardly through the base member 26 from the underside of the locking pawl 28 in a direction toward the front end of the release arm 24. Depression of the key swings the lower rod 10 and thereby the release arm 24 upwardly, whereby this eventually swings the locking pawl 28 free from its engagement with the first curve guide 19 via the lever part 30. The arrangement is so adapted that this takes place precisely at the moment when the hammer strikes the string. This entails that the hammer strikes the string. This entails that the hammer is withdrawn from the string with a greater speed than this vibrates, since the pressure from the first guide boss or roller 18 against the first curve guide 19 causes this to momentarily swing into its second, retracted position in which the geometry of the rod system no longer allows the hammer to reach the string, even if the key is pressed totally home. This situation is shown in FIG. 3.

The striking mechanism moreover comprises a check device which is generally designated by 32a and which serves to stop and temporarily retain the hammer during rebound. The check device 32a consists of a stationary check part 32b arranged on the base member 26 and a complementarily shaped, movable check part 32c which is swingably connected with the hammer butt 5 via an arm 33. An upwardly protruding projection 34, which is arranged upwardly on the locking pawl 28 rests against the underside of the movable check part 32c and lifts it for engagement with the stationary check part 32b at the same moment as the locking pawl 28 is disengaged from the first curve guide 19. The hammer is hereby caught and retained immediately during rebound so that it can only strike the string once.

When the pianist reduces or removes the pressure against the key, the pressure in the rod system is reduced or removed correspondingly, so that the compression spring 31 is now capable of forcing the first curve guide 19 back to its first, advanced position again. This entails that the pianist can immediately repeat the strike as desired, and, as will be seen, this can take place in the immediate vicinity of the bottom position of the key and much more rapidly and easily than known before. The pianist also has a better keyboard touch or feel and can better control the strike since the rod system never releases the connection between the key and the hammer.

When the string has been struck, its vibrations shall be terminated again to give place to the note from the next string which is to be struck. This takes place by means of a damper 35, which is arranged on a lever arm 36, and which is normally kept engaged with the string 2 by means of a spring 37 acting on the lever arm with a biassed pressure force. When the key is pressed down, and the lower rod 10 is thereby caused to swing about its bearing 14, the damper 35 is lifted free of the string 2 by a boss 38 on the rearwardly extending arm 15 of the lower rod. The string 2 can now vibrate freely when struck by the hammer, but the vibrations are stopped as soon as the key returns to its rest position.

In conventional striking mechanisms the key depression resistance is between 60 and 80 grams, which is thus the force which a pianist is usually accustomed to have to provide with the fingers when depressing the keys. However, the striking mechanism of the invention is lighter than the conventional mechanisms, and part of the already smaller weight is moreover absorbed by the first curve guide 19. The spring 22, which is fixed between the release arm 24 and the rear end 8c of the key 8a, is biassed with a spring force bringing the key resistance up to the usual 60–80 grams. However, the key resistance can be adjusted by means of the adjusting screw 23 within wide limits in accordance with the desires and finger forces of the pianist. The spring force to which the spring 22 subjects the rod system 10, 11 and 12, moreover provides a considerable contribution to the achievement of a desired rapid and safe rebound.

As shown in e.g. FIG. 1, the striking mechanism comprises a damper bar 39 extending longitudinally of the overall keyboard. At the sides of the keyboard the damper bar is swingably journalled in bearings 40 and can swing about a horizontal axis between the rear position shown in FIG. 1 in which the damper bar rests against a fixed stop bar 41, and the front position shown in FIG. 4. Swing to a desired position takes place by means of a link connection (not shown) between the damper bar and the pedal (not shown) which the pianist can actuate with his foot.

The damper bar also serves to bring the rest position of the hammer closer to the string when its loudness is to be damped, since less genetic energy is then added to the string because of the shorter distance the hammer will travel before striking the string.

If the distance between the first curve guide 19 in its advanced position and the second curve guide 21 is constant, the key cannot return to its rest position when released by the pianist, since it will remain standing in the position to which the key must usually be pressed down to swing the hammer forwardly to its new rest position corresponding to the desired damping.

The second curve guide 21, which is a bar in the shown example extending longitudinally of the entire keyboard, is therefore swingably suspended from bearings 42 at the sides of the keyboard, where the curve guide is moreover firmly connected with a damper arm 43. Upwardly each of these damper arms has a groove 44 engaged by a pin 45 on a control rod 46 arranged at each of the ends of the damper bar.

When the damper bar is swung forwardly, as shown in FIG. 4, the damper bar swings the damper arm 43 in the opposite direction again via the engagement of the pin 45 with the groove 44 in the damper arm 43, whereby the second curve bar is swung sufficiently rearwardly in the direction of the arrow A in FIG. 4 for the key to now being fully allowed to return to its rest position.

As will be seen from FIG. 4, the distance between the first and the second curve guides has now been increased, however, so that there is play between the first curve guide and the associated guide roller when, in case of damping, the key is present in its rest position. This entails that the key during depression carries with it the hammer only when this play has been eliminated, i.e. when the key is pressed down to the position corresponding to the new rest position of the hammer.

However, a considerable portion of the key resistance in the striking mechanism of the invention is caused by the spring 22, and this entails the advantage that during depression of the key at damping the pianist does not, like in the conventional striking mechanisms, meet an abrupt transition from the initial light movement, which only presents low resistance, to the actual striking movement where the resistance suddenly increases to full size.

Another advantage obtained by means of the damping arrangement described above is that, in contrast to the conventional striking mechanisms, damping is possible in the entire range from full loudness to full damping, i.e. to a loudness of 0. The reason is that the play in the damping arrangement described above can be made so great that the hammer begins its swing movement simultaneously with the release of the first curve guide 19 by the locking pawl 28.

The curve 25 of the first curve guide 19 can be shaped in any expedient manner, but it is particularly advantageous if the curve is so shaped that the striking movement of the hammer takes place with increasing speed when the key is pressed down with a constant speed. This enables the pianist to play with more light and shade, while the strike is felt more supple and inspiring.

No matter how the curve 25 of the first curve guide 19 is shaped, the curve 47 of the second curve guide 21 can advantageously be formed as the envelope of the movement described by the second guide boss or roller when the first guide boss or roller follows the curve of the first curve guide during the striking movement. This entails that during depression of the key the operation of the mechanism will be even and free of play to the greatest extent possible.

FIG. 5 shows a second embodiment of a striking mechanism according to the invention. This embodiment, which is generally designated by 101, is constructed in essentially the same manner as the structure described above, and parts serving the same purpose and having the same function as in this are therefore designated by the same references with an increment of 100. This striking mechanism 101 has horizontal strings 102, and the hammer shank 104 of the hammer 103 is likewise arranged substantially horizontally.

In this case too the check device **132*a* comprises a stationary check part 132*b* and a complementarily shaped, movable check part 132*c* which is swingably connected with the hammer butt 105. A swing arm 48, resting against the rear side of the movable check part 132*c*, is arranged swingably about a bearing 49 on the first instrument part 107. Downwardly, the swing arm 48 moreover has a forwardly directed projection 51 which engages an abutment 50 on the rearwardly extending arm 115 of the lower rod 110, when the lower rod 110 disengages the locking pawl 128 from the first curve guide 119 via the lever part 130. The swing arm 48 is hereby turned and presses the movable check part 132*c* into engagement with the stationary check part 132*b*, so that the hammer 103** is catched rapidly and safely at the correct moment.

In contrast to conventional striking mechanism, the striking mechanism of the invention comprises a damper bar 139 proper, which is swingably journalled in bearings 140 at the sides of the keyboard. This damper bar serves the same purpose and operates in the same manner as the damper bar of the embodiment described previously; however, the mechanism for swinging it while increasing the distance of the second curve guide 121 to the first curve guide 119 is arranged in a slightly different manner. When the string or the set of strings is to be damped, the damper bar 139 is lifted to the desired height by means of a lever 52 which is arranged at each side of the keyboard and which is connected via a connection (not shown) with a pedal (not shown) which can be operated by the pianist with the foot. Each lever 52 mounts a guideway 53 which is formed with a groove 54. The second curve guide 121, which consists of a bar extending longitudinally of the entire keyboard, is swingably suspended from bearings 142 at the sides of the keyboard and moreover engages with the groove 54 of the guideway 53 by means of a pin 55. This entire arrangement is such that the second curve guide 121 is spaced so much from the first curve guide 119 in the same manner as in the previously described example with vertical strings that, at damping, the second guide boss or roller 120 does not, or only insignificantly, touch the second curve guide when the key is in its rest position.

In conventional striking mechanisms for e.g. grand pianos the relatively large weight from the substantially horizontally arranged hammer is transmitted via the entire power transmitting system to lead counterweights which are mounted in the key. The striking mechanism of the invention comprises a spring 56 which is connected partly with a fixed instrument part 57, partly with the hammer butt 105. This spring 56 is biassed by a force which totally or partly absorbs the weight of the hammer 103. This weight therefore does not load the power transmitting mechanism between the key and the hammer, or at any rate just to a minor degree, and this entails that the striking mechanism will operate more easily and be worn less.

The function of the striking mechanism 101 otherwise corresponds to the function of the previously described striking mechanism 1 and will therefore not be mentioned in further detail.

FIG. 6 shows a third embodiment of a striking mechanism according to the invention. This embodiment, which is generally designated by 201, corresponds to the embodiment just described apart from the structure of the first and the second guide boss or roller, and the same parts are therefore designated by the same references with an additional increment of 100.

As shown, in this embodiment the first and the second guide rollers or bosses are integrated in a single guide roller 58 running along the first curve guide 219 during the striking movement and along the second curve guide 221 during the return movement. This structure is lighter, cheaper and more reliable in operation than the structures described before. When the distance between the first and the second curve guides 219, 221 is the same as the diameter of the roller 58, and the curve 225 of the first curve guide 219 is a cylinder face with the same radius as this diameter, the second curve 59 on the second curve guide 221 is advantageously reduced to a single point or rather edge.

Otherwise, as mentioned, the third embodiment 202 shown in FIG. 6 corresponds to the embodiment 101 shown in FIG. 5 and will therefore not be mentioned in further detail here.

The first and second guide bosses or rollers of the first embodiment shown in FIGS. 1–4 as well as in the second embodiment shown in FIG. 5 can advantageously be integrated in a single roller in the same manner as in the third embodiment.

I claim:

1. A striking mechanism (1) for a piano, grand piano or similar string instrument, essentially comprising, for each string or set of strings (2), a hammer butt (5) journalled swingably about a horizontal axis and having a hammer shank (4) carrying a hammer (3) at the free end; a power transmission device acting between the hammer butt (5) and the rear end **(8*c*) of the associated key (8) in the keyboard of the instrument for momentarily causing the hammer (3) to strike the string (2) when the key is pressed down; and a check device (32*a*) serving to stop and temporarily retain the hammer (5) during rebound when said hammer has struck the string once, characterized in that the power transmission device consists of a rod system preferably movably arranged in the swing plane of the hammer (3), said rod system comprising a lower rod (10) downwardly resting against an abutment (13) on the key and swingably journalled in a fixed instrument part (7) by mean of a rearwardly extending arm (15); an upper rod (12) upwardly connected swingably with the hammer butt (5); as well as at least one intermediate rod (11) swingably connected with the other rods (10, 12) and said intermediate rod having, at a rod system deflection side at striking, a first curve boss or roller (18) supported by a first curve guide (19) during the striking movement, and on an opposite side from the deflection side, a second guide boss or roller (20) supported by a second curve guide (21) during the rebound movement; and that the first curve guide (19) is arranged movably in the plane of the rod system on a fixed base member (26) in the instrument, said base member (26) being formed with a locking means (28, 30) to releasably lock the curve guide (19) in a first, advanced position in which the rod system is capable of causing the hammer (3) to touch the string (2), said striking mechanism (1) having a release means (24) for releasing the locking means (28, 30) by continued depression of the key (8) such that the curve guide (19) is pressed back to a second, retracted position by the first guide boss or roller (18) in which it is not possible for the rod system to cause the hammer (3) to touch the string (2), as well as a device (31) to return the curve guide (19)** to its first advanced position upon cessation or sufficient reduction of the depression force applied to the key.

2. A striking mechanism according to claim 1, characterized in that the first curve guide (19) is swingably journalled downwardly on the base member (26) and is effected in a direction inwardly toward the first guide boss or roller (18) by a biassed spring (22); that the locking means comprises a locking pawl (28) swingably journalled upwardly on the base member (26) and locking the curve guide (19) releasably in a first position by engagement with the upper end of the curve guide, and a lever part (30) preferably arranged vertically slidably in connection with the base member (26); and that the release means consists of a release arm (24) arranged on the lower rod (10), said release arm extending below the lever part (30) and serving to lift it during the striking movement such that the upper end of the lever part (30) swings the locking pawl (28) out of the locking engagement with the curve guide (19), and this is hereby pressed into a second position by the first guide boss or roller (18) as soon as the hammer (3) has struck the string (2) once.

3. A striking mechanism according to claim 1, for a piano, characterized in that the check **(32*a*) consists of a stationary check part (32*b*) and a complementarily shaped, movable check part (32*c*) which is swingably connected with the hammer butt (5), and that the upper side of the locking pawl (28) is formed with an upwardly protruding projection (34) which rests against the underside of the movable check part (32*c*) and is so adapted that it causes the movable check part (32*c*) to engage the stationary check part (32*b*) when the locking pawl (28) is disengaged from the first curve guide (19)**.

4. A striking mechanism according to claim 2, for a piano, characterized in that the check **(32*a*) consists of a stationary check part (32*b*) and a complementarily shaped, movable check part (32*c*) which is swingably connected with the hammer butt (5), and that the upper side of the locking pawl (28) is formed with an upwardly protruding projection (34) which rests against the underside of the movable check part (32*c*) and is so adapted that it causes the movable check part (32*c*) to engage the stationary check part (32*b*) when the locking pawl (28) is disengaged from the first curve guide (19)**.

5. A striking mechanism according to claim 1 for a grand piano, characterized in that the check device (132*a*) consists of a stationary check part (132*b*) and a complementarily shaped, movable check part (132*c*) swingably connected with a hammer butt (105), and that a swing arm (48) is arranged on a fixed instrument part (107), said swing arm having an upper part resting against the rear side of the movable check part (132*c*) and a lower part engaged with an abutment (5) on the lower rod (110) such that the movable check part (132*c*) engages the stationary check part (132*b*) when the lower rod (110), via the lever part (130), disengages the locking pawl (128) from the first curve guide (119).

6. A striking mechanism according to claim 2 for a grand piano, characterized in that the check device (132*a*) consists of a stationary check part (132*b*) and a complementarily shaped, movable check part (132*c*) swingably connected with a hammer butt (105), and that a swing arm (48) is arranged on a fixed instrument part (107), said swing arm having an upper part resting against the rear side of the movable check part (132*c*) and a lower part engaged with an abutment (5) on the lower rod (110) such that the movable check part (132*c*) engages the stationary check part (132*b*) when the lower rod (110), via the lever part (130), disengages the locking pawl (128) from the first curve guide (119).

7. A striking mechanism according to claim 1, for a piano, comprising a damper bar (39) arranged swingably about a horizontal axis in the instrument for moving the rest position of the hammer (3) closer to the string (2) when less loudness is desired at striking, characterized in that the mechanism comprises at least a substantially vertically arranged damper arm (43) capable of tilting about a bearing (42), which is arranged on a fixed instrument part (7) with a relatively small upward spacing from the second curve guide (21) which is secured to the downwardly facing part of the damper arm (43), the upwardly facing part of the damper arm (43) engaging a control rod (46) associated with the damper bar (39) such that the second curve guide (31), in any of the positions of the damper bar (39), is spaced sufficiently from the first curve guide (19) such that the second guide boss or roller (20) does not, or only insignificantly, touch the second curve guide (21) when the key is in the rest position.

8. A striking mechanism according to claim 2, for a piano, comprising a damper bar (39) arranged swingably about a horizontal axis in the instrument for moving the rest position of the hammer (3) closer to the string (2) when less loudness is desired at striking, characterized in that the mechanism comprises at least a substantially vertically arranged damper arm (43) capable of tilting about a bearing (42), which is arranged on a fixed instrument part (7) with a relatively small upward spacing from the second curve guide (21) which is secured to the downwardly facing part of the damper arm (43), the upwardly facing part of the damper arm (43) engaging a control rod (46) associated with the damper bar (39) such that the second curve guide (31), in any of the positions of the damper bar (39), is spaced sufficiently from the first curve guide (19) such that the second guide boss or roller (20) does not, or only insignificantly, touch the second curve guide (21) when the key is in the rest position.

9. A striking mechanism according to claim 3, for a piano, comprising a damper bar (39) arranged swingably about a horizontal axis in the instrument for moving the rest position of the hammer (3) closer to the string (2) when less loudness is desired at striking, characterized in that the mechanism comprises at least a substantially vertically arranged damper arm (43) capable of tilting about a bearing (42), which is arranged on a fixed instrument part (7) with a relatively small upward spacing from the second curve guide (21) which is secured to the downwardly facing part of the damper arm (43), the upwardly facing part of the damper arm (43) engaging a control rod (46) associated with the damper bar (39) such that the second curve guide (31), in any of the positions of the damper bar (39), is spaced sufficiently from the first curve guide (19) such that the second guide boss or roller (20) does not, or only insignificantly, touch the second curve guide (21) when the key is in the rest position.

10. A striking mechanism according to claim 1, for a grand piano, characterized in that it comprises a damper bar (139) which serves to move the rest position of the hammer (103) closer to the string (102) or set of strings (102) when less loudness is desired, and which can swing about a horizontal axis (140) via a swing arm journalled in a fixed instrument part (57), and that the mechanism more-over comprises at least one lever (52) connected with a damper pedal for swinging the swing arm, and that the second curve guide (121) is swingably journalled in a fixed instrument pat (142), said lever (52) engaging the curve guide (121) such that, in any of the positions of the damper bar (139), it is spaced sufficiently from the first curve guide (119) such that the second guide boss or roller (120) does not, or only insignificantly, touch the second curve guide (121) when the key is in its rest position.

11. A striking mechanism according to claim 2, for a grand piano, characterized in that it comprises a damper bar (139) which serves to move the rest position of the hammer (103) closer to the string (102) or set of strings (102) when less loudness is desired, and which can swing about a horizontal axis (140) via a swing arm journalled in a fixed instrument part (57), and that the mechanism more-over comprises at least one lever (52) connected with a damper pedal for swinging the swing arm, and that the second curve guide (121) is swingably journalled in a fixed instrument part (142), said lever (52) engaging the curve guide (121) such that, in any of the positions of the damper bar (139), it is spaced sufficiently from the first curve guide (119) such that the second guide boss or roller (120) does not, or only insignificantly, touch the second curve guide (121) when the key is in its rest position.

12. A striking mechanism according to claim 1, characterized in that a spring (22) is fixed between the rear end part (8*c*) of the key and the release arm (24) of the lower rod (10), said spring having a biassed spring force which can be adjusted by means of an adjusting screw (23) and which preferably has such a size that, together with the other reaction force from the mechanism, it essentially imparts the same depression resistance to the key as is found in conventional string instruments of this type.

13. A striking mechanism according to claim 2, characterized in that a spring (22) is fixed between the rear end part (8*c*) of the key and the release arm (24) of the lower rod (10), said spring having a biassed spring force which can be adjusted by means of an adjusting screw (23) and which preferably has such a size that, together with the other reaction force from the mechanism, it essentially imparts the same depression resistance to the key as is found in conventional string instruments of this type.

14. A striking mechanism according to claim 3, characterized in that a spring (22) is fixed between the rear end part (8*c*) of the key and the release arm (24) of the lower rod (10), said spring having a biassed spring force which can be adjusted by means of an adjusting screw (23) and which preferably has such a size that, together with the other reaction force from the mechanism, it essentially imparts the same depression resistance to the key as is found in conventional string instruments of this type.

15. A striking mechanism according to claim 1, characterized in that a curve (25) of the first curve guide (19) is formed such that the striking movement of the hammer takes place with an increased speed when the key is pressed down with a constant speed.

16. A striking mechanism according to claim 2, characterized in that a curve (25) of the first curve guide (19) is formed such that the striking movement of the hammer takes place with an increased speed when the key is pressed down with a constant speed.

17. A striking mechanism according to claim 1, characterized in that a curve of the second curve guide (21) is the envelop of the movement described by the second guide boss or roller (20) when the first guide boss or roller (18) follows the curve (25) of the first curve guide (19) during the striking movement.

18. A striking mechanism according to claim 2, characterized in that a curve of the second curve guide (21) is the envelop of the movement described by the second guide boss or roller (20) when the first guide boss or roller (18) follows the curve (25) of the first curve guide (19) during the striking movement.

19. A striking movement according to claim 1, for a grand piano, characterized in that the mechanism comprises a spring (56) or similar device which is connected partly with a fixed instrument part (57), partly with a hammer butt (105) or the hammer shank (104), and that said spring (56) or similar device is biassed by a force acting on the hammer butt (105) or the hammer shank (104) in the same direction as the striking movement.

20. A striking mechanism according to claim 1, characterized in that the first and second guide bosses or rollers are integrated in one guide boss or roller (58).

* * * * *